US012501997B2

(12) United States Patent
Arndt et al.

(10) Patent No.: US 12,501,997 B2
(45) Date of Patent: Dec. 23, 2025

(54) IN-RAIL ANTI-TIP BRACKET FOR MOBILE STORAGE SYSTEMS

(71) Applicant: SPACESAVER CORPORATION, Fort Atkinson, WI (US)

(72) Inventors: Preston Arndt, Watertown, WI (US); Thomas Gregory Tralmer, Janesville, WI (US); Kenneth Richard Durfee, Jr., Janesville, WI (US); Steven Janson, Deerfield, WI (US); Stephen Anderson, Roscoe, IL (US); Sean Krause, Fort Atkinson, WI (US)

(73) Assignee: SPACESAVER CORPORATION, Fort Atkinson, WI (US)

( * ) Notice: Subject to any disclaimer, the term of this patent is extended or adjusted under 35 U.S.C. 154(b) by 188 days.

(21) Appl. No.: 18/541,275

(22) Filed: Dec. 15, 2023

(65) Prior Publication Data

US 2025/0194794 A1 Jun. 19, 2025

(51) Int. Cl.
*A47B 53/02* (2006.01)
*A47B 97/00* (2006.01)

(52) U.S. Cl.
CPC ..... *A47B 53/02* (2013.01); *A47B 97/00* (2013.01); *A47B 2097/008* (2013.01)

(58) Field of Classification Search
CPC .... A47B 53/02; A47B 97/00; A47B 2097/008
See application file for complete search history.

(56) References Cited

U.S. PATENT DOCUMENTS 4,618,191 A * 10/1986 Peterman ..... A47B 53/02 104/248
4,911,507 A 3/1990 Leist
5,013,101 A * 5/1991 Muth ..... A47B 53/02 312/201
5,050,504 A * 9/1991 Mulcaster ..... A47D 13/04 104/242
5,205,627 A 4/1993 Davison
5,597,217 A * 1/1997 Hoska ..... A47B 53/02 104/248
6,158,601 A 12/2000 Baker
6,161,485 A * 12/2000 Muth ..... A47B 53/02 105/157.1

(Continued)

*Primary Examiner* — Daniel J Rohrhoff
(74) *Attorney, Agent, or Firm* — Andrus Intellectual Property Law, LLP

(57) ABSTRACT

An anti-tip assembly mounted to a movable carriage of a mobile storage system that is movable along the length of a channel member. The anti-tip assembly includes at least two anti-tip bracket assemblies that are each mounted below the movable carriage and are received within the channel member. Each anti-tip bracket assembly includes a mounting bracket secured to the carriage and an engagement bracket that includes a hook portion. The engagement bracket is laterally movable relative to the mounting bracket such that the location of the hook portion can vary during movement of the movable carriage. The engagement bracket and the mounting bracket are mounted to each other to allow for movement while also limiting lateral movement of the engagement bracket. The hook portion includes an engagement flange that contacts an engagement lip of the channel member to restrict tipping a storage unit supported on the carriage.

20 Claims, 5 Drawing Sheets

(56) References Cited

U.S. PATENT DOCUMENTS

| | | | | |
|---|---|---|---|---|
| 6,843,180 | B1 * | 1/2005 | Keaton | A47B 53/02<br>104/248 |
| 7,950,331 | B2 * | 5/2011 | Tourdot | A47B 53/02<br>104/106 |
| 2004/0065224 | A1 * | 4/2004 | Gilbert | A47B 53/02<br>104/137 |
| 2011/0062100 | A1 * | 3/2011 | Webb | A47B 53/00<br>211/183 |

* cited by examiner

IN-RAIL ANTI-TIP BRACKET FOR MOBILE STORAGE SYSTEMS

BACKGROUND

The present disclosure generally relates to a mobile storage system, and more particularly to an anti-tip arrangement for such a mobile storage system. More specifically, the present disclosure relates to an anti-tip arrangement mounted to a movable storage unit that interacts with a floor mounted channel member to limit possible tipping while also being flexible to allow for tolerance variations and component movement.

A mobile storage system typically includes one or more movable storage units supported on a series of spaced apart parallel rails. In a mobile storage system, the movable storage units are typically in the form of a shelving system that is mounted to a movable carriage having wheels that are supported on the spaced apart guide rails. In another type of mobile storage system, the movable carriages include wheels supported on a floor and are movable along the length of a channel member mounted to or embedded in the floor.

Various anti-tip arrangements are known for preventing the movable storage units from tipping relative to the guide rails or channel members. One example of such an anti-tip arrangement is shown and described in Peterman U.S. Pat. No. 4,618,191, the disclosure of which is hereby incorporated by reference. The '191 patent discloses an anti-tip system in which a groove is formed in the side of the rail. An anti-tip member is carried by the carriage and is pivotably mounted to the carriage for movement between an operative position and an inoperative position. In the operative position, a hook section of the anti-tip member is engaged within the groove in the rail. In the inoperative position, the hook section of the anti-tip member is positioned out of engagement with the groove in the rail. The anti-tip member further includes a retainer section which is adapted to receive a releasable retainer such as a pin, for selectively maintaining the anti-tip member in the operative position. The hook section and the retainer section are located on the same side of the pivot axis about which the anti-tip member is pivotable between the operative and inoperative positions. With this construction, the retainer section and the hook section hang downwardly when the anti-tip member is in the inoperative position. The anti-tip member is pivoted from the inoperative position to the operative position when the carriage is mounted to the rail, either by engaging the retainer section and applying an upward force or by engaging the hook section and applying an inward force. The retainer section of the anti-tip member is located over the rail, and access to the retainer section of the anti-tip member is complicated by the components of the carriage located vertically above the retainer section of the anti-tip member. The hook section is accessible from the side, which is also complicated by the components of the carriage. In addition, the hook member is located within a space defined between the rail and a base member to which the rail is mounted, and the base obstructs access to the hook member. Thus, in either case, it is difficult for a user to manipulate the retainer section of the anti-tip member in order to move the anti-tip member from the disengaged position to the engaged position, and to simultaneously engage the retainer pin with the retainer section of the anti-tip member when the anti-tip member is in the operative position.

In another construction, the rail includes an upwardly facing base or channel to which a support bar is mounted, to reduce the overall height of the rail. The channel includes a lip that extends inwardly toward the support bar. An anti-tip arrangement for this type of rail construction utilizes a C-shaped anti-tip member that is engaged with the carriage after the carriage is mounted to the rail. The anti-tip member includes an upper section that is mounted to the carriage, and a lower section that is received within the space defined between the lip of the channel and the lower wall of the channel, to prevent the carriage from tipping relative to the rail. While this arrangement is functional, it is disadvantageous in that the anti-tip member is in a fixed position when mounted to the carriage, which requires a larger gap between the lip of the rail channel and the support bar than is desired.

Another illustrative embodiment of an anti-tip arrangement is shown in U.S. Pat. No. 6,843,180. In this example, an anti-tip arrangement includes an anti-tip member that is pivotably mounted to the movable carriage. The anti-tip member includes a hook section that engages an engagement surface of the rail to prevent tipping of the entire movable storage unit. The hook section is on one side of the floor mounted rail and can be moved between two separate positions to prevent tipping and to allow the hook to be lifted out of the engagement position to allow for location of the movable storage unit along the guide rails.

SUMMARY

The present disclosure relates to a mobile storage system, and more particularly to an anti-tip assembly for such a mobile storage system. More specifically, the present disclosure relates to an anti-tip assembly mounted to a movable storage unit that interacts with a floor mounted channel member to limit possible tipping while also being flexible to allow for tolerance variations and component movement.

The mobile storage system of the present disclosure includes a channel member having a bottom wall, a pair of spaced side walls that are perpendicular to the bottom wall and an engagement lip that extends laterally from each of the two side walls. The engagement lips are spaced from each other to define an open channel in the channel member. The mobile storage system includes one or more movable storage units that each include a carriage that is movable along the length of the channel member. Each storage unit includes at least one anti-tip assembly that is mounted to the carriage and restricts the tipping movement of the storage unit. The anti-tip assembly includes a first mounting bracket that is secured to the carriage. A first engagement bracket is mounted to and laterally movable relative to the first mounting bracket and includes a first hook. A second engagement bracket and a second mounting bracket are spaced from the first engagement bracket and mounting bracket such that the first and second hooks are positioned beneath the engagement lips of the rail when the carriage is positioned for movement along the rail.

During movement of the carriage along the channel member, the first and second engagement brackets extend through the open channel of the channel member. The lateral movement of the engagement brackets allow the first and second mounting bracket assemblies to compensate for variations in the clearance space of the open channel and/or non-parallel movement of the carriage or carriages.

The movement of the engagement bracket relative to the mounting bracket is limited by the interaction between movement slots on the engagement bracket and guide features on the mounting bracket. The guide features are each movable in the movement slots and the ends of the movement slots limit the amount of lateral movement of the engagement brackets. The length of the movement slot in this way defines the degree of movement to define an extended position and a retracted position for the mounting bracket assemblies.

Each of the engagement brackets includes a hook that is located below the engagement lips of the channel member. When the storage unit begins to tip or experiences uplift, engagement flanges on the hook contact the engagement lips of the channel member to limit further tipping movement.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
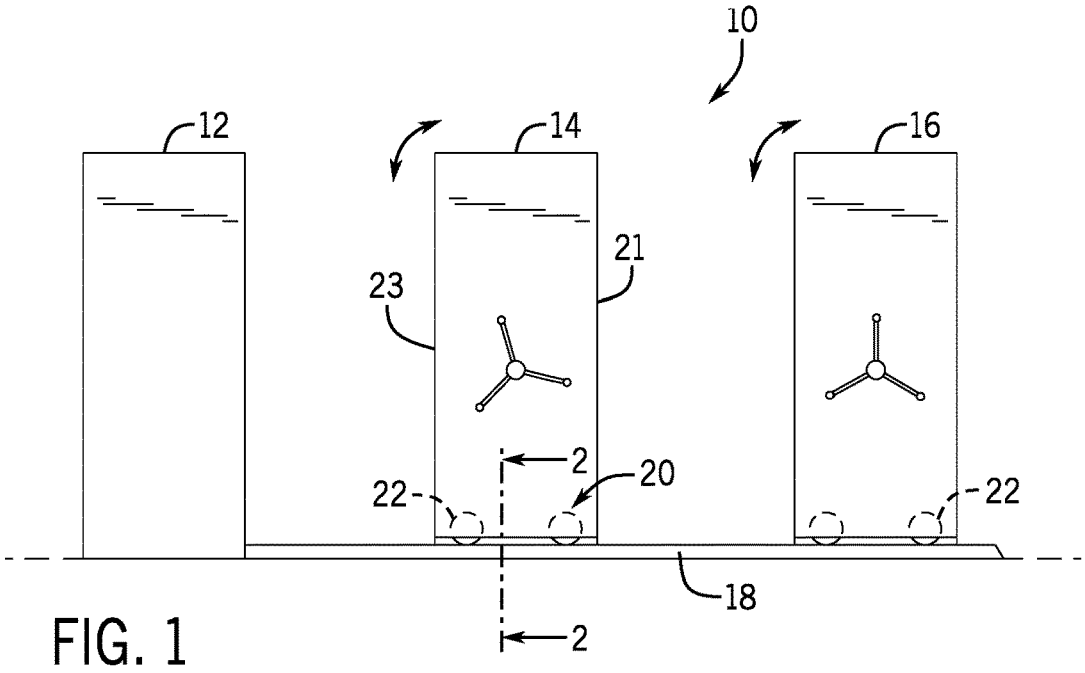
FIG. 1 is a side elevation view showing a mobile storage system that incorporates the anti-tip assembly of the present disclosure.

FIG. 1 illustrates a mobile storage system 10 that includes a series of storage units 12, 14 and 16 that are each designed to store and support a series of items. In the embodiment shown in FIG. 1, storage unit 12 is stationary while the storage units 14 and 16 are each movable along a series of parallel, spaced apart channel members 18 in a manner as is generally known. Storage units 14, 16 are movable along the length of the channel members 18 together and apart, to selectively create an aisle or space for providing access to the contents of the storage units, 12, 14 and 16. Although storage unit 12 is shown in FIG. 1 as being stationary, it is contemplated that the storage unit 12 could also be movable along the channel members 18. In addition, although only three storage units are shown in the embodiment of FIG. 1, it should be understood that additional or fewer storage units could be utilized as part of the mobile storage system 10 of the present disclosure.

As is generally illustrated in FIG. 1, each of the storage units 14, 16 includes a lower carriage 20 that spans across the parallel channel members 18 for movably supporting each of the storage units 14, 16 as the storage units 14, 16 move along the length of the channel members 18. In the embodiment shown in FIG. 1, each of the carriages 20 includes a series of wheels 22 that are located near the first and second sides 21, 23 of the storage unit and near each of the ends of the storage unit.

Figure 2:
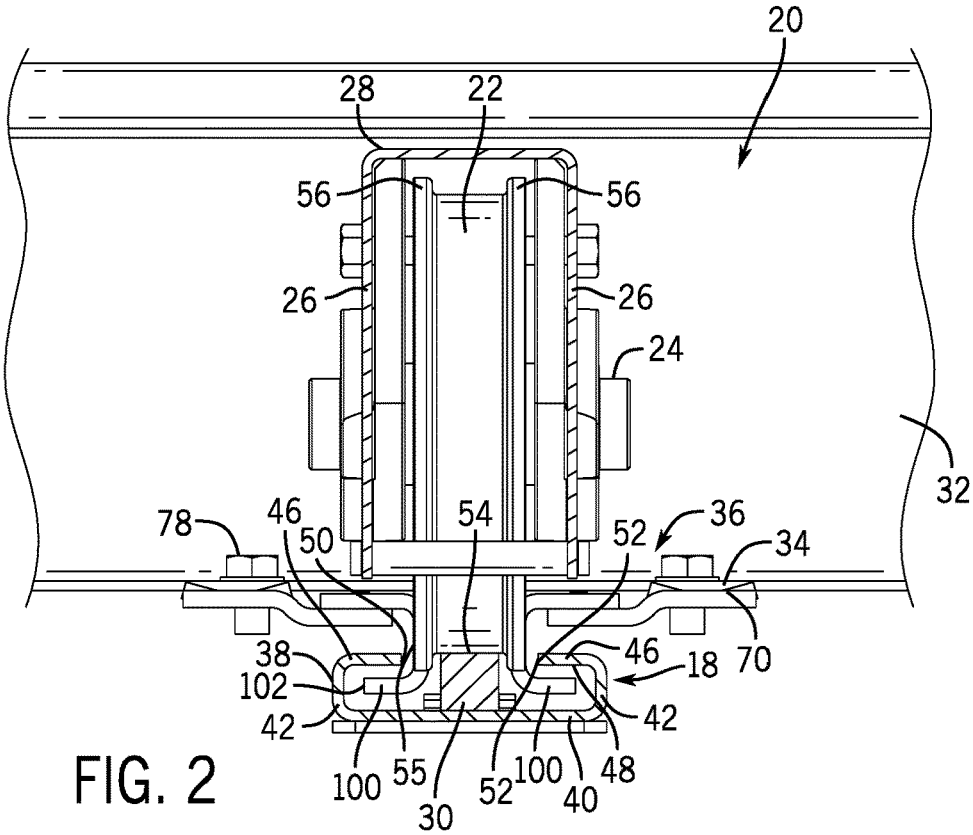
FIG. 2 is a partial section view taken along line 2-2 of FIG. 1 showing the anti-tip assembly in a rail guided carriage configuration.

FIG. 2 is a section view taken along line 2-2 of FIG. 1 that further illustrates carriage 20 of the present disclosure. As shown in this figure, wheel 22 is rotatably supported by an axle 24 that is supported between a pair of side walls 26 of a housing 28. In an embodiment in which the mobile storage system includes a rail guided carriage, each channel members 18 would include a rail 30 and each carriage 20 would include four separate wheels 22 that are each movable along the rail 30 formed as part of the channel member 8. In alternate embodiments in which the carriage is supported directly on the floor, the wheels 22 would be spaced away from the channel members 18 and would not be guided directly by the channel members 18. In such embodiment, the channel members 18 would not include the rail 30 and would function as part of an anti-tipping arrangement.

The carriage 20 includes a pair of front and rear cross beams 32 that are joined to each other by the housings 28 that each extend parallel to the axis of the channel members 18. Each of the cross beams 32 includes a lower wall 34 that extends along the entire width of each of the storage units 14, 16. The lower wall 34 serves as a point of attachment for an anti-tip assembly 36 that is designed to interact with one of the channel members 18 to prevent tipping of each of the movable storage units 14, 16 in the direction shown by the arrows in FIG. 1. Since each of the storage units 14, 16 can have a height that approaches 6-8 feet, overloading either of the storage units 14, 16 near the top end of the storage unit or on one side and not the other could result in tipping of the storage unit 14, 16. Further, each of the storage units could be subject to tipping due to various conditions outside of normal operating conditions, such as seismic events, incidental contact with material handling equipment (forklift), users climbing on shelving, or uneven loaded and sudden stop of mobile shelving units.

Referring back to FIG. 2, each of the channel members 18 includes a channel body 38 that includes a bottom wall 40 and a pair of spaced apart side walls 42. The bottom wall 40 is adapted for placement on or within a subfloor or main floor of a building. When positioned as shown in FIG. 2, channel body 38 is upwardly open. As shown in FIG. 2, each of the side walls 42 extends upwardly from one of the ends of the bottom wall 40 and terminates in an inwardly extending lip 46 at its upper end. The underside of each lip 46 defines a downwardly facing and laterally extending engagement surface 48. Each of the lips 46 terminates at an inner edge 50 that defines the width of an open channel 52. The open channel 52 allows for the anti-tipping assembly 36 to be received in the channel member 18.

The channel member 18 further includes the longitudinally extending rail 30 that is mounted to the bottom wall 40 of the channel body 38 and is positioned generally midway between the pair of spaced side walls 42. The rail 30 is in the form of a metallic bar having a generally rectangular cross section that includes an upwardly facing support surface 54. As shown in FIG. 2, the rail 30 extends upward into the open channel 52 defined between the inner edges 50 of the pair of spaced lips 46. The rail 30 creates a pair of movement channels 55 that each exist on opposite sides of the rail 30 between the rail 30 and the inner edge 50 of one of the pair of spaced lips 46. In the embodiment of the mobile storage system shown, each of the wheels 22 includes outer lips 56 that are positioned on opposite sides of the rail 30 and travel within the movement channels 55 to help guide the movement of the wheels 22 along the longitudinal length of the rail 30. In an embodiment of the mobile storage system in which the wheels travel along the floor and not along the rails 30, the rail 30 could be eliminated from the channel member 18.

Figure 3:
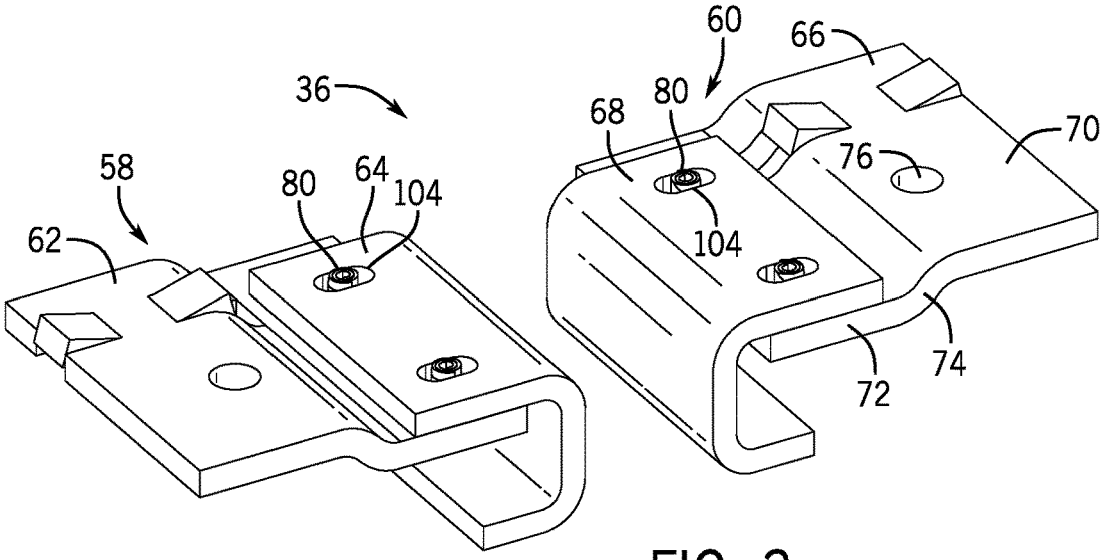
FIG. 3 is a perspective view of two of the anti-tip assemblies removed from the mobile storage system.
Figure 4:
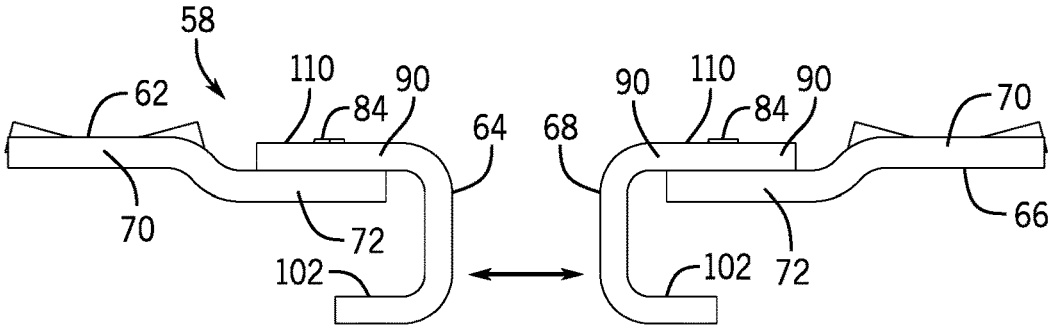
FIG. 4 is an end view of the two anti-tip assemblies shown in FIG. 3.

As illustrated in FIG. 2, the anti-tip assemblies 36 are mounted to the lower wall 34 of the cross beam 32 that forms part of the movable carriage 20. FIGS. 3 and 4 illustrate one of the anti-tip assemblies 36 that is removed from the individual storage units. In the embodiment shown in FIGS. 3 and 4, the anti-tip assembly 36 includes both a first bracket assembly 58 and a second bracket assembly 60 that are each similar to each other and are used in combination to form one of the anti-tip assemblies 36.

The first bracket assembly 58 includes a first mounting bracket 62 and a first engagement bracket 64 while the second bracket assembly 60 includes a second mounting bracket 66 and a second engagement bracket 68. In the embodiment shown in FIGS. 3 and 4, the first and second mounting brackets 62, 66 are similar components that are mirror images of each other while the first and second engagement brackets 64, 68 are identical components. In the following discussion, the first and second mounting brackets 62, 66 and the first and second engagement brackets 64, 68 will be described using common reference numerals for common portions of each of the brackets.

Each of the first and second mounting brackets 62, 66 includes a mounting portion 70 and a support portion 72 that are joined to each other by a connecting portion 74. The connecting portion 74 is a bend in a metal plate that forms the mounting portion 70 and the support portion 72. The connecting portion 74 allows the support portion 72 to be located slightly below the mounting portion 70. As shown in the side view of FIG. 4, the support portion 72 is located below the mounting portion 70 by a distance that is slightly greater than the thickness of the engagement bracket 64 or 68 supported on the support portion 72 to allow movement of the engagement bracket 64 or 68, as will be described below. The mounting portion 70 includes at least one attachment opening 76. Although each of the first and second mounting brackets 62, 66 are shown and described as being formed from a single metallic plate bent into the desired configuration, it is contemplated that the first and second mounting brackets 62, 66 could be formed from two separate plates joined to each other in a stacked configuration. In such embodiment, the support portion 72 would still be located below the connecting portion 74 to allow for movement of the engagement brackets 64 or 68 when the first and second bracket assemblies are assembled as shown in FIGS. 3 and 4.

Referring back to FIG. 2, the attachment opening 76 is sized to receive a connector 78 that extends through the lower wall 34 of the cross beam 32 and the mounting portion 70 to secure the first and second mounting brackets 62, 66 to the lower wall 34.

Figure 6:
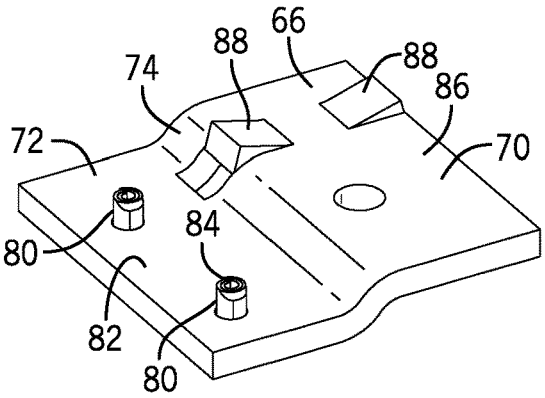
FIG. 6 is a perspective view of the support mounting bracket.

Referring now to FIG. 6, the mounting bracket 66 further includes a pair of guide features 80 that extend upward from the generally planar top surface 82 of the mounting portion 70. In the embodiment shown, each of the guide features 80 is in the form of a guide pin. However, the guide features 80 could have other configurations, such as material extrusions, screws, or any other element that can extend from the planar top surface 82. In the embodiment shown, the guide feature 80 has a height such that a top end 84 of each of the guide features 80 is generally aligned with a top surface 86 of the mounting portion 70. The mounting bracket 66 further includes a pair of alignment tabs 88 that each extend above the top surface 86. The alignment tabs 88 are included to align the respective mounting bracket with an edge surface of the cross beam of the carriage.

Figure 5:
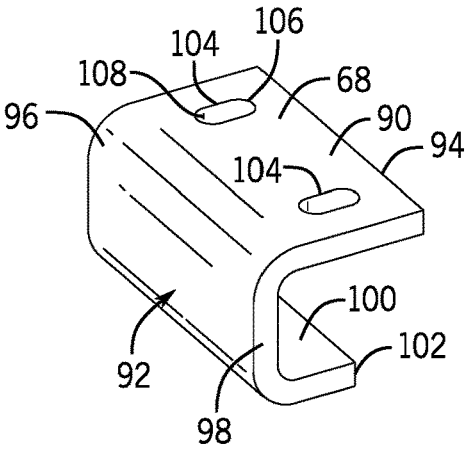
FIG. 5 is a perspective view of the hook engagement bracket.

Referring now to FIG. 5, the engagement bracket 68 is formed from a single metal plate that is bent into the general U-shape and includes an attachment portion 90 and a hook portion 92. The attachment portion 90 and the hook portion 92 combined to create the U-shape for the entire engagement bracket 68. As shown in FIG. 5, the attachment portion 90 extends laterally from a first edge 94 to a second edge 96 that is joined to a vertical wall 98 that forms part of the hook portion 92. The vertical wall 98 transitions to an engagement flange 100 that extends perpendicular to the vertical wall 98 and parallel to the attachment portion 90. The engagement flange 100 terminates at hook edge 102.

The attachment portion 90 of each of the engagement brackets 64, 68 include a pair of movement slots 104 that each extend between an inner end 106 and an outer end 108. The width of each of the movement slots 104 is designed to receive and accommodate movement of one of the guide features 80 formed on the corresponding mounting bracket 62 or 66, as best shown in FIG. 3. As shown in FIG. 4, the top end 84 of each of the guide features 80 only slightly extends past the top surface 110 of the attachment portion 90 when the first bracket assembly 58 and the second bracket assembly 60 are assembled as shown in FIG. 4. In this assembled condition, the attachment portion 90 of the first engagement bracket 64 is supported along the support portion 72 of the first mounting bracket 62 while the attachment portion 90 of the second engagement bracket 68 is received along the support portion 72 of the second mounting bracket 66.

In accordance with the present disclosure, the guide features 80 and movement slots 104 are specifically designed to allow relative lateral movement of the engagement brackets relative to the stationary mounting brackets. In this manner, the distance between the pair of hook edges 102 can vary to adjust the distance between the spaced first and second engagement brackets 64, 68 as shown by the arrow in FIG. 4. The amount of lateral movement of each of the first and second engagement brackets 64, 68 is dictated by the overall length of the movement slots 104 between the outer end 108 and the inner end 106.

Figure 7:
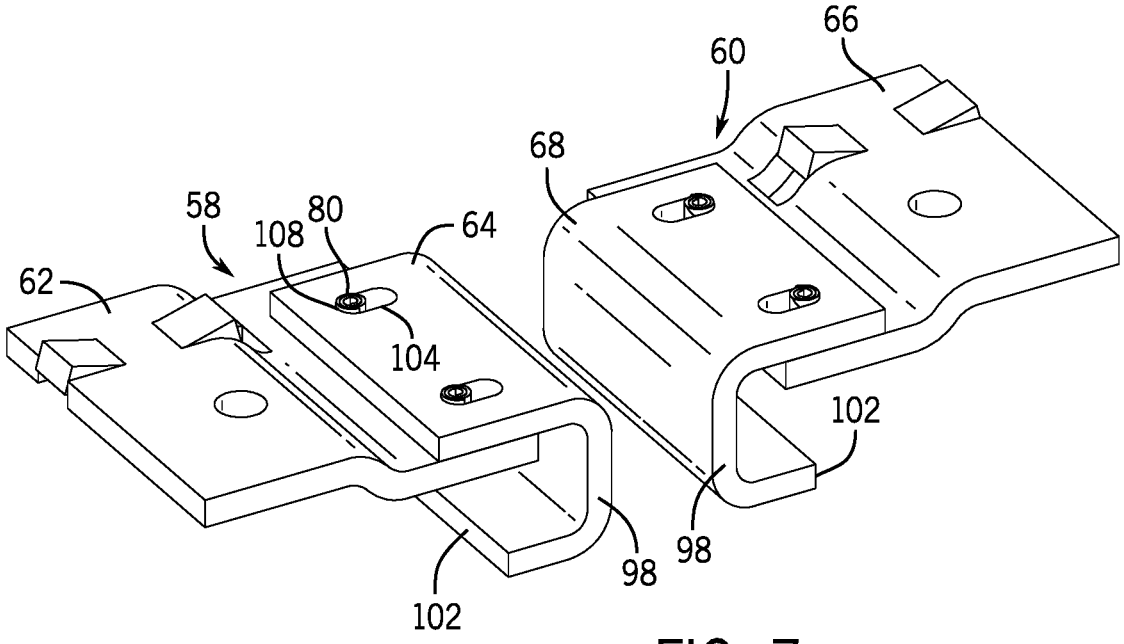
FIG. 7 is a perspective view of the two anti-tip assemblies in the fully extended position.

Referring now to FIG. 7, the first and second bracket assemblies 58, 60 are shown in a fully extended position in which the first and second engagement brackets 64, 68 are moved toward each other along the support portion of the mounting brackets 62, 66. In this fully extended position, the distance between the hook edges 102 is at a minimum. In this position, each of the guide features 80 is in contact with an outer end 108 of the movement slot 104. In this position, each of the engagement brackets 64, 68 are moved closest to each other. As was previously discussed, the first engagement bracket 64 is movable along the stationary first mounting bracket 62 while the second engagement bracket 68 is movable along the second mounting bracket 66.

Figure 8:
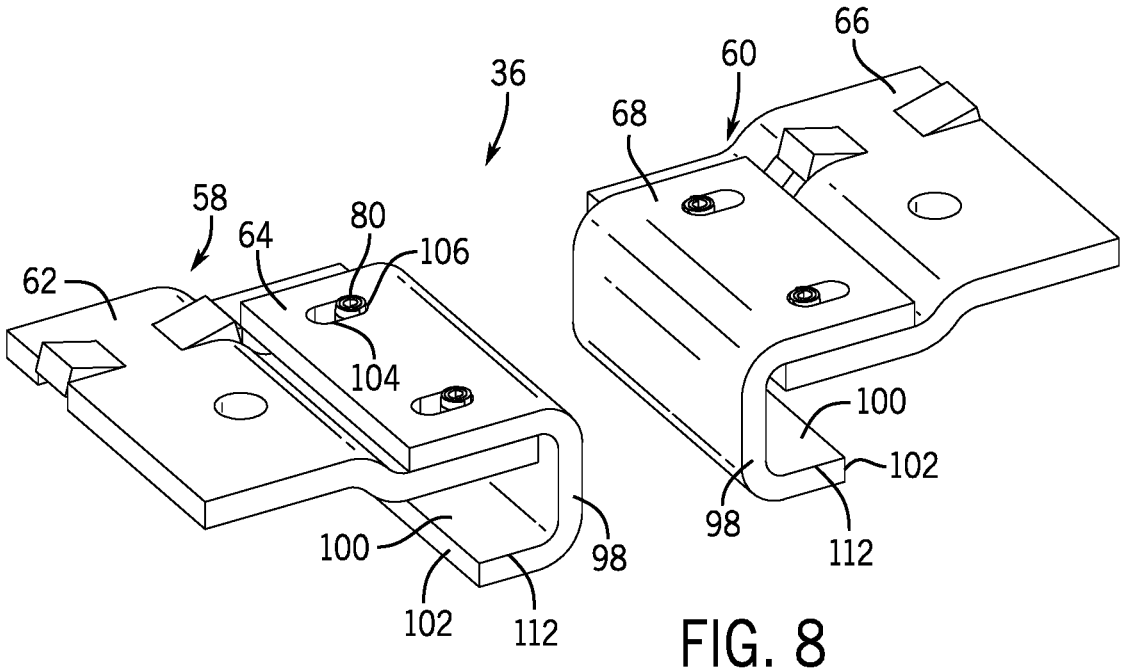
FIG. 8 is a perspective view of the two anti-tip assemblies in the fully retracted position.

FIG. 8 illustrates the first and second bracket assemblies 58, 60 in a fully retracted position in which the distance between the hook edges 102 is at a maximum. In this position, each of the guide features 80 is in contact with the inner end 106 of the respective mounting slot 104. In its fully retracted position, the first engagement bracket 64 is moved laterally outward as far as possible relative to the stationary first mounting bracket 62 while the second engagement bracket 68 is moved laterally outward the furthest possible distance relative to the second mounting bracket 66.

The relative movement of the mounting bracket and the engagement bracket allows the distance between the vertical walls 98 of the first and second engagement brackets 64, 68 to adjust to compensate for variations in the width of the pair of movement channels 55 formed in the open channel 52 of the channel member 18 by the location of the rail 30, as is shown in FIG. 2. Since each of the engagement brackets 64, 68 is independently movable relative to the stationary mounting brackets 62 and 66, the adjustable movement of the pair of engagement brackets allows the anti-tip assembly 36 to adjust for slight variations in the width of the pair of movement channels 55 formed as part of the open channel 52 as each of the storage units along the length of the channel members, which prevents binding such as if the carriage is not perpendicular to the rail (carriage racking).

As each of the engagement brackets 64, 68 laterally moves relative to its respective mounting bracket 62, 66, the engagement flange 100 remains beneath the engagement lip 46 of the channel member 18. Even in the most extended position as shown in FIG. 7, the distance between the pair of hook edges 102 is greater than the width of the respective movement channel 55 formed as part of the open channel 52. In this manner, the anti-tip assembly 36 cannot become disengaged from the channel member 18 during normal movement of the storage units along the length of the channel member 18.

Figure 9A:
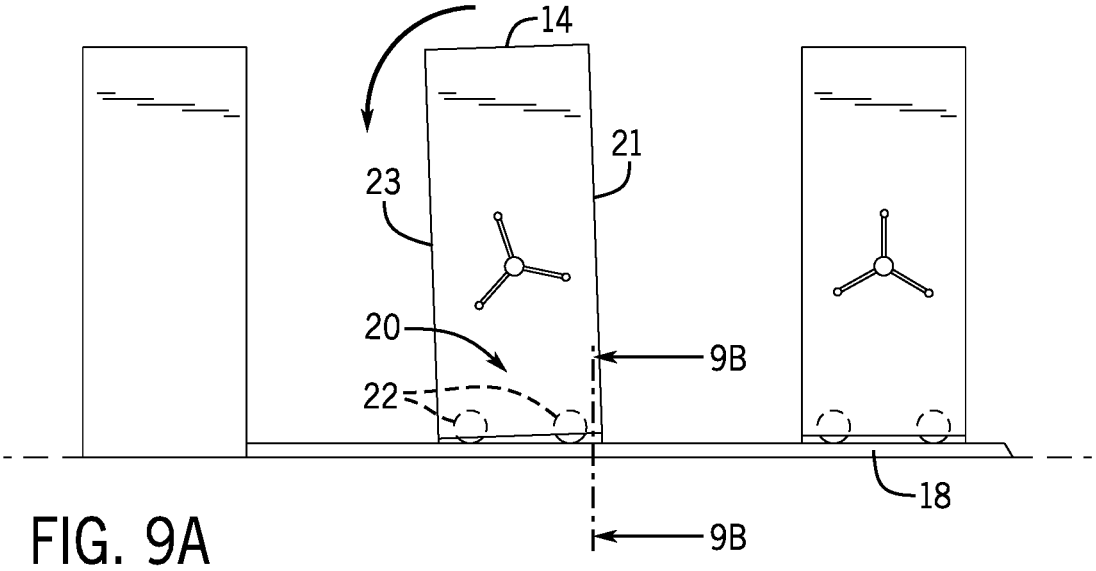
FIG. 9A is a side elevation view showing the tipping of one of the storage units in a first direction.
Figure 9B:
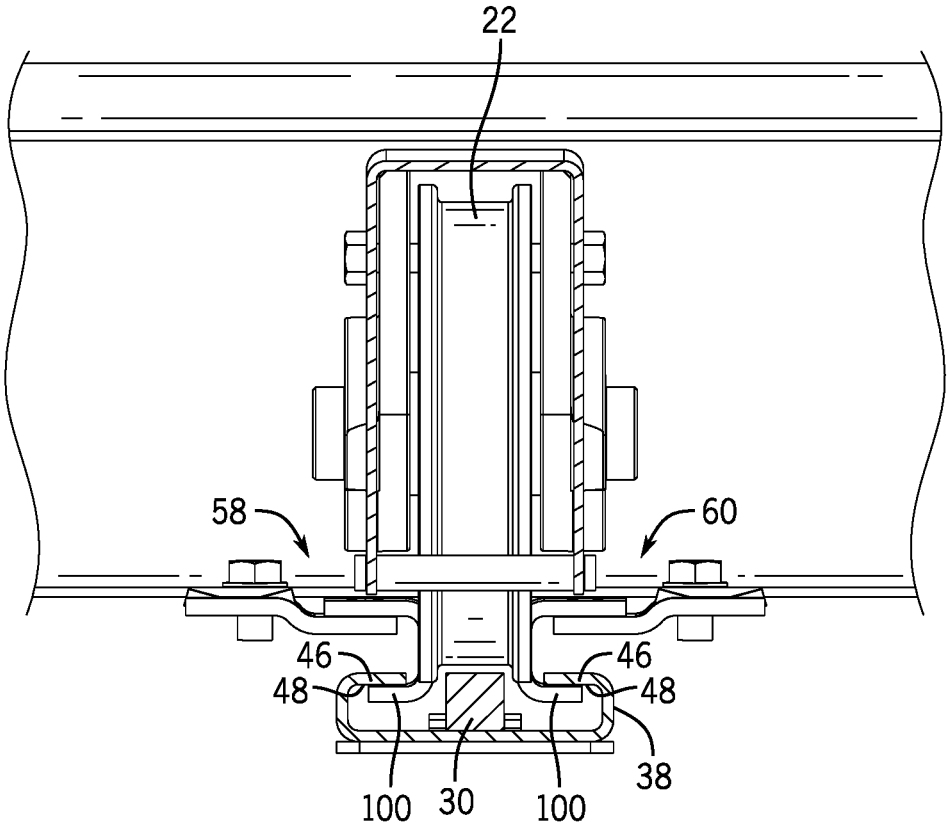
FIG. 9B is a partial section view along line 9B-9B in FIG. 9A showing the interaction between the anti-tip assembly and the channel member in a rail guided carriage configuration to prevent tipping in a first direction.

Referring now to FIGS. 9A-9B, the function of each of the first and second bracket assemblies 58, 60 to prevent tipping of the respective storage unit in the first direction shown by the arrow in FIG. 9A is shown. In the embodiment of FIG. 9A, an anti-tip assembly including the first and second bracket assemblies 58, 60 is located near each of the wheels 22.

When the storage unit 14 begins to tip in the first direction toward the second side 23 of the storage unit 14, as shown by the arrow, the first side 21 of the storage unit begins to lift the carriage 20 away from the channel member 18 to begin to lift at the first side 21. As shown in FIG. 9B, as the storage unit 14 begins to tip, the first and second bracket assemblies 58, 60 near the first side 21 each move upward toward the engagement lips 46 of the channel body 38 until the engagement flanges 100 contact the engagement surface 48. The physical contact between the engagement flanges 100 and the engagement lips 46 further opposes any further tipping movement. As shown in FIG. 9B, the wheel may come out of contact with the rail 30 during such tipping of the storage unit 14.

Figure 10A:
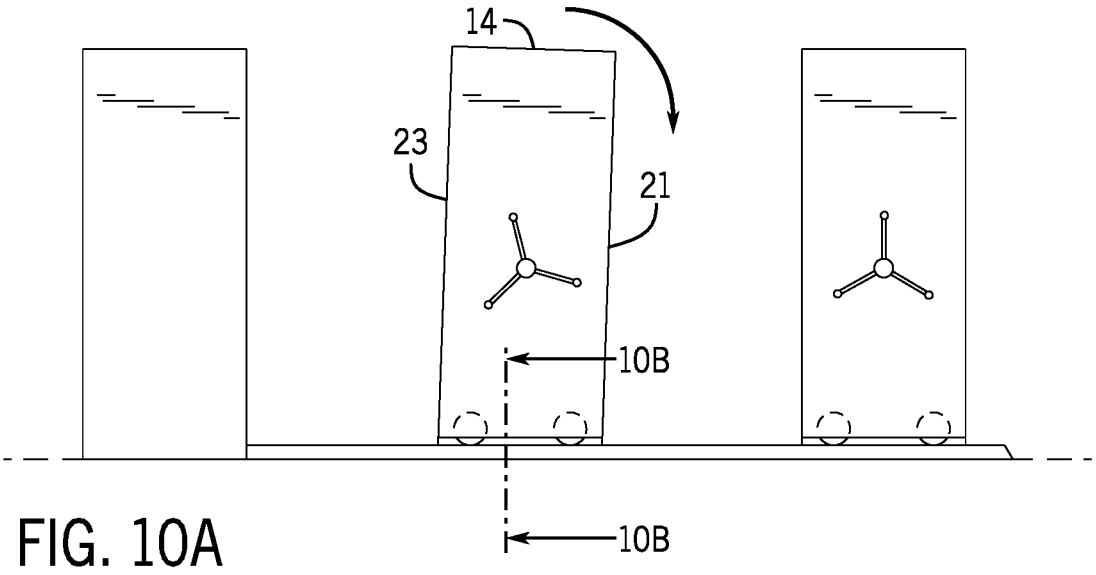
FIG. 10A is a side elevation view showing the tipping of one of the storage units in a second direction.
Figure 10B:
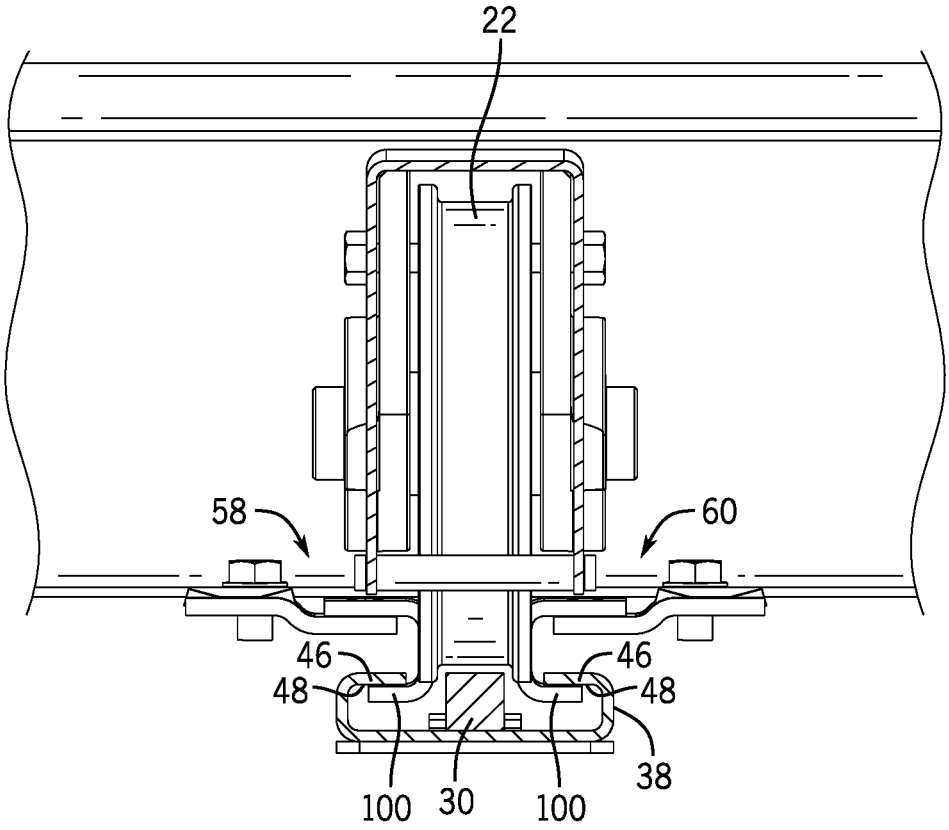
FIG. 10B is a partial section view along line 10B-10B in FIG. 10A showing the interaction between the anti-tip assembly and the channel member to prevent tipping in the second direction.

Referring now to FIGS. 10A-10B, the function of each of the first and second bracket assemblies 58, 60 to prevent tipping of the respective storage unit in a second direction shown by the arrow in FIG. 10A is shown. In the embodiment of FIG. 10A, an anti-tip assembly including the first and second bracket assemblies 58, 60 is located near each of the wheels 22.

When storage unit 14 begins to tip in the second direction toward the second side 21 of the storage unit 14, as shown by the arrow, the second side 23 of the storage unit begins to lift carriage 20 away from the channel member 18 at the second side 23. As shown in FIG. 10B, as the storage unit 14 begins to tip, the first and second bracket assemblies 58, 60 near the second side 23 each move upward toward the engagement lips 46 of the channel body 38 until the engagement flanges 100 contact the engagement surface 48. The physical contact between the engagement flanges 100 and the engagement lips 46 further opposes any further tipping movement. As shown in FIG. 10B, wheel 22 may come out of contact with the rail 30 during such tipping of the storage unit.

As discussed previously, it is contemplated that the mobile storage system 10 of the present disclosure would include an anti-tip assembly near both a first side 21 and a second side 23 of the storage unit and near each of the ends of the storage unit. In the embodiment illustrated, the storage unit would include four separate anti-tip assemblies where each of the anti-tip assemblies includes both a first bracket assembly 58 and a second bracket assembly 60. The use of the four separate anti-tip assemblies prevents tipping movement of any one of the movable storage units in either direction. In various embodiments, fewer or more anti-tip assemblies could be utilized to restrict the tipping movement.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A mobile storage system, comprising:

a channel member including a bottom wall, a pair of spaced side walls that are perpendicular to the bottom wall and engagement lips each extending laterally inward from the side walls and each engagement lip having an inner edge, wherein the inner edges of the engagement lips are spaced from each other to define an open channel;

a carriage movable along a length of the channel member, the carriage including at least one cross beam;

an anti-tip assembly mounted to the carriage, the anti-tip assembly comprising:

a first mounting bracket securely mounted to the at least one cross beam;

a first engagement bracket including a first hook, the first engagement bracket being laterally movable relative to the first mounting bracket;

a second mounting bracket securely mounted to the at least one cross beam;

a second engagement bracket including a second hook, the second engagement bracket being laterally movable relative to the second mounting bracket, wherein the first and second hooks are positioned beneath the engagement lips of the channel member when the carriage is positioned for movement along the channel member.

2. The mobile storage system of claim 1, wherein the first and second engagement brackets are movable within the open channel of the channel member.

3. The mobile storage system of claim 1, wherein each of the first and second engagement brackets are U-shaped and include an attachment portion and the first or second hook.

4. The mobile storage system of claim 3, wherein the first and second mounting brackets each include a mounting portion and support portion, wherein the support portion is located below the mounting portion and is in contact with the attachment portion of the first or second engagement bracket such that the attachment portion of the first or second engagement bracket moves along the support portion.

5. The mobile storage system of claim 4, wherein the attachment portion of each of the first and second engagement brackets includes a movement slot that receives a guide feature extending from the support portion of each of the first and second mounting brackets, wherein the interaction between the movement slots and the guide features limits the lateral movement of the first and second engagement brackets.

6. The mobile storage system of claim 1, further comprising a rail extending along a length of the channel member and located within the open channel, wherein the first and second hooks are positioned between the rail and the engagement lips of the channel member when the movable carriage is positioned for movement along the length of the channel member.

7. The mobile storage system of claim 1, wherein the first and second engagement brackets are independently movable relative to each other.

8. The mobile storage system of claim 1, further comprising a storage unit supported on the movable carriage and movable along the length of the channel member with the movement of the carriage.

9. A mobile storage system, comprising:

a channel member including a bottom wall, a pair of spaced side walls that are perpendicular to the bottom wall and engagement lips each extending laterally inward from the side walls and each engagement lip having an inner edge, wherein the inner edges of the engagement lips are spaced from each other to define an open channel;

a carriage movable along a length of the channel member; and an anti-tip assembly mounted to the carriage, the anti-tip assembly comprising:

a first mounting bracket securely mounted to the carriage;

a first engagement bracket including a first hook, the first engagement bracket being laterally movable relative to the first mounting bracket;

a second mounting bracket securely mounted to the movable carriage;

a second engagement bracket including a second hook, the second engagement bracket being laterally movable relative to the second mounting bracket, wherein the first and second hooks are positioned beneath the engagement lips of the channel member when the carriage is positioned for movement along the channel member, wherein the first and second engagement brackets each include a movement slot that receives a guide feature extending from each of the first and second mounting brackets, wherein the interaction between the movement slots and the guide features limits the lateral movement of the first and second engagement brackets.

10. A mobile storage system, comprising:

a channel member including a bottom wall, a pair of spaced side walls that are perpendicular to the bottom wall and engagement lips each extending laterally inward from the side walls and each engagement lip having an inner edge, wherein the inner edges of the engagement lips are spaced from each other to define an open channel;

a carriage movable along a length of the channel member, the carriage including at least one cross beam; and at least two anti-tip bracket assemblies mounted to the movable carriage, the anti-tip bracket assemblies each comprising:

a mounting bracket securely mounted to the at least one cross beam of the movable carriage; and an engagement bracket including a hook portion, the engagement bracket being laterally movable relative to the mounting bracket;

wherein the hook portions each include an engagement flange positioned beneath one of the engagement lips of the channel member when the movable carriage is positioned for movement along the channel member.

11. The mobile storage system of claim 10, wherein the at least two anti-tip bracket assemblies are aligned with and spaced from each other.

12. The mobile storage system of claim 11, wherein the engagement flanges of the hook portions extend in opposite directions when the at least two anti-tip bracket assemblies are mounted to the movable carriage.

13. The mobile storage system of claim 10, wherein each engagement flange terminates at a hook edge, wherein the distance between the hook edges is greater than a width of the open channel.

14. The mobile storage system of claim 10, wherein the engagement brackets are each movable laterally within the open channel of the channel member.

15. The mobile storage system of claim 14, wherein the engagement brackets each include a movement slot that receives a guide feature extending from one of the mounting brackets, wherein the interaction between the movement slots and the guide features limits the lateral movement of the engagement brackets.

16. The mobile storage system of claim 10, wherein engagement bracket is U-shaped and includes an attachment portion and the hook portion.

17. The mobile storage system of claim 16, wherein the mounting bracket includes a mounting portion and support portion, wherein the support portion is located below the mounting portion and is in contact with the attachment portion of the engagement bracket such that the attachment portion of the engagement bracket moves along the support portion.

18. The mobile storage system of claim 17, wherein the attachment portion of each engagement bracket includes a movement slot that receives a guide feature extending from the support portion of the mounting bracket, wherein the interaction between the movement slots and the guide features limits the lateral movement of the engagement bracket.

19. The mobile storage system of claim 10, further comprising a rail extending along the length of the channel member and located within the open channel, wherein the hooks are positioned between the rail and the engagement lips of the channel member when the movable carriage is positioned for movement along the channel member.

20. The mobile storage system of claim 10, further comprising a storage unit supported on the carriage and movable along the length of the channel member with the movement of the carriage.

* * * * *